United States Patent [19]

Adachi

[11] 4,347,462

[45] Aug. 31, 1982

[54] DISCHARGE LAMP LIGHTING DEVICE

[75] Inventor: Hiromi Adachi, Kamakura, Japan

[73] Assignee: Mitsubishi Denki Kabushiki Kaisha, Tokyo, Japan

[21] Appl. No.: 218,151

[22] Filed: Dec. 19, 1980

[30] Foreign Application Priority Data

Dec. 27, 1979 [JP] Japan ..... 54-170768

[51] Int. Cl.[3] ..... H05B 41/16

[52] U.S. Cl. ..... 315/290; 315/101; 315/207; 315/227 R; 315/DIG. 2

[58] Field of Search ..... 315/101, 106, 200 R, 315/207, 227 R, 289, 290, DIG. 2, DIG. 5

[56] References Cited

U.S. PATENT DOCUMENTS 4,119,886 10/1978 Jyomura et al. ..... 315/101

4,165,475 8/1979 Pegg et al. ..... 315/106 X

*Primary Examiner*—Eugene R. La Roche

*Attorney, Agent, or Firm*—Sughrue, Mion, Zinn, Macpeak & Seas

[57] ABSTRACT

A discharge lamp starting device such as for a fluorescent lamp in which a nonlinear capacitor is connected in parallel with a discharge lamp with a Zener diode connected in series with the nonlinear capacitor. A semiconductor switching device, such as a diode thyristor, is connected in parallel with the discharge lamp. Due to the presence of the Zener diode, the semiconductor switching device can have a wide range of threshold voltage so that the cost of the device is low.

4 Claims, 5 Drawing Figures

DISCHARGE LAMP LIGHTING DEVICE

BACKGROUND OF THE INVENTION

1. Field of the Invention

The present invention relates to a discharge lamp starting device for a fluorescent lamp which employs a semiconductor switch and a nonlinear capacitor.

A nonlinear capacitor has been developed by TDK Electronics Co., Ltd. (Tokyo Denkikagaku Kogyo Kabushiki Kaisha) which utilizes a polycrystal of $BaTiO_3$ to provide a desired nonlinearity. This nonlinear capacitor is briefly described in "Journal of Electronic Engineering", March 1980, page 20.

2. Description of the Prior Art

An example of a conventional discharge lamp starting device using a nonlinear capacitor and semiconductor switch is shown in FIG. 1. With this device, the discharge lamp can be started substantially instantaneously. In FIG. 1, reference numeral 1 designates a fluorescent lamp, 2 an inductive stabilizer, 3 a semiconductor switch or a bi-directional diode thyristor (silicon symmetrical switch—SSS), 4 and 5 diodes, 6 a resistor, 7 a nonlinear capacitor, and U and V power source terminals. FIG. 2 shows the waveform of the voltage developed across the lamp 1.

In the circuit shown in FIG. 1, an AC voltage e as indicated by the dotted line in FIG. 2 is applied between the power source terminals U and V. In the initial starting period, when the supply voltage e reaches the breakdown voltage of the thyristor 3 at a phase angle $\theta_1$, the thyristor 3 is turned on as a result of which current is allowed to flow through the stabilizer 2 to preheat the filaments of the lamp 1. The preheating current becomes zero at a phase angle $\theta_2$ and the thyristor 3 is turned off. At this point, the voltage of the capacitor 7 is zero and the supply voltage e is close to the negative peak value. After the supply voltage e reaches the negative peak value, the capacitor 7 is charged with the polarity indicated in FIG. 1. The capacitor 7 has a saturable characteristic with the relation between the voltage V and the charge Q being as shown in FIG. 3. IF the capacitor characteristic is selected so that the capacitor voltage is in the nonlinear region when the supply voltage is lower than the peak value, the charging current to the capacitor 7 is abruptly decreased when the voltage reaches the nonlinear region. Due to the inductive stabilizer 2, the voltage of the charged capacitor abruptly increases. That is, a pulse voltage $V_1$ shown in FIG. 2, which has a peak value much higher than the supply voltage peak value, is applied to the lamp 1.

After the pulse voltage has been generated, the supply voltage 2 is applied to the lamp until the thyristor 3 is turned off again. This condition is maintained unchanged until the lamp 1 has been started. When the lamp 1 has been started, the lamp voltage becomes lower than the supply voltage e. In addition, because of the action of the resistor 6, the charging current to the capacitor 7 when the lamp voltage is in the positive direction is decreased and the lamp voltage in the positive direction becomes lower than the threshold voltage of the thyristor 3. Thus, a stable discharge operation is maintained in the lamp 1. In this case, the capacitor 7 is charged to the polarity as illustrated in FIG. 1 through the diode 5 when the lamp voltage is in the negative direction so that the lamp voltage is increased. However, the lamp is maintained discharged due to the diode 4.

As is apparent from the above description, the threshold voltage $V_{BO}$ of the diode thyristor 3 must be higher than the lamp voltage $V_3$ after the discharge and lower than the supply voltage peak value $V_4$. However, if the threshold voltage is high enough to approach the peak value $V_4$, then the firing phase angle $\theta_1$ of the thyristor 3 lags and thereby decreases the preheating current. Accordingly, the range of $V_{BO}$ actually required for the diode thyristor 3 is smaller than $V_3$-$V_4$. However, a diode thyristor having such a small range of $V_{BO}$ is considerably expensive, and accordingly a discharge lamp lightning device using such a diode thyristor is also expensive.

SUMMARY OF THE INVENTION

In view of the foregoing, in accordance with the invention there is provided a discharge lamp starting device having a nonlinear capacitor connected in parallel with a discharge lamp. A Zener diode is connected in series with the nonlinear capacitor so that a diode thyristor having a wide range of $V_{BO}$ (threshold or breakover voltage) can be employed whereby the cost of the thyristor device is reduced and accordingly the cost of the circuit is also reduced.

The nature, principle and utility of the invention will become more apparent from the following detailed description when read in conjunction with the accompanying drawings.

DESCRIPTION OF THE PREFERRED EMBODIMENTS

Figure 4:
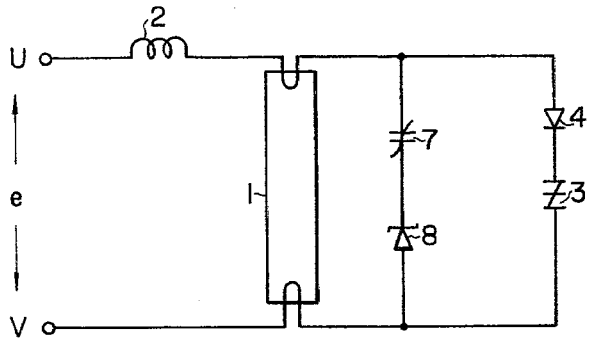
FIG. 4 is a circuit diagram showing a preferred embodiment of a discharge lamp lighting device according to the present invention.
Figure 5:
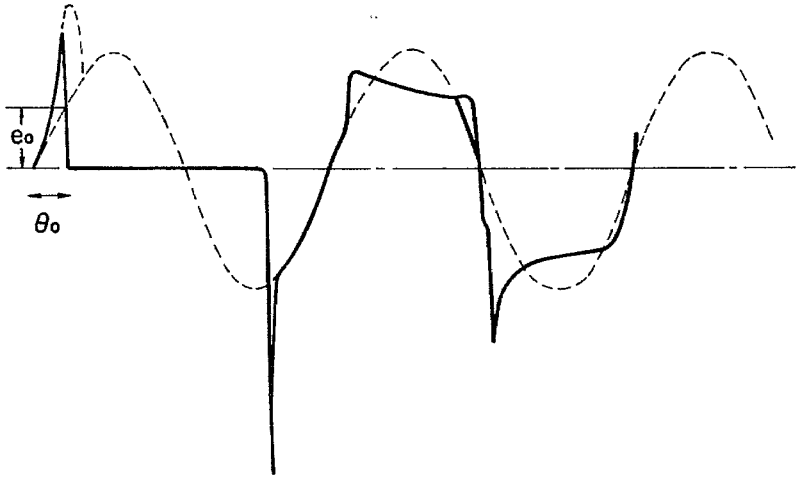
FIG. 5 is a waveform diagram showing a voltage across a discharge lamp in FIG. 4.

FIG. 4 is a circuit diagram showing a preferred embodiment of a discharge lamp lighting device according to the invention. FIG. 5 is a waveform diagram showing the voltage across the terminals of a discharge lamp for a description of the operation of the preferred embodiment of FIG. 4.

Figure 1:
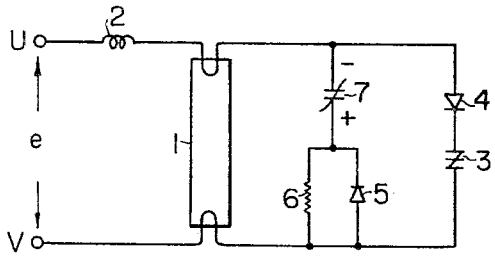
FIG. 1 PRIOR ART
FIG. 1 is a circuit diagram of a conventional discharge lamp lighting device.
Figure 2:
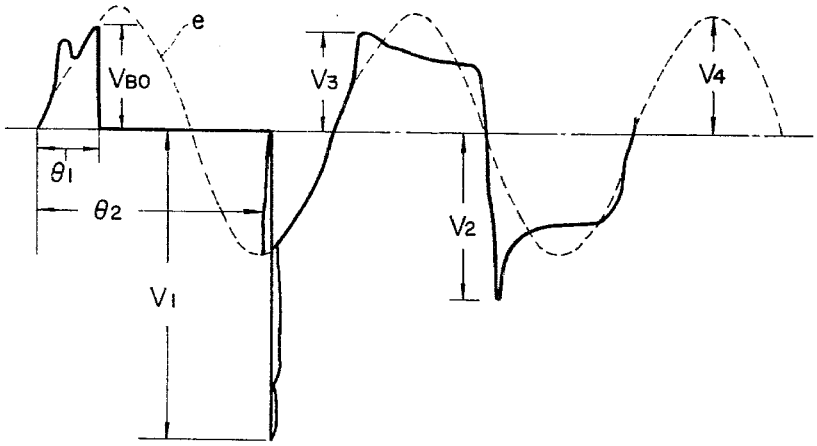
FIG. 2 is a waveform diagram showing a voltage developed across a lamp in FIG. 1.
Figure 3:
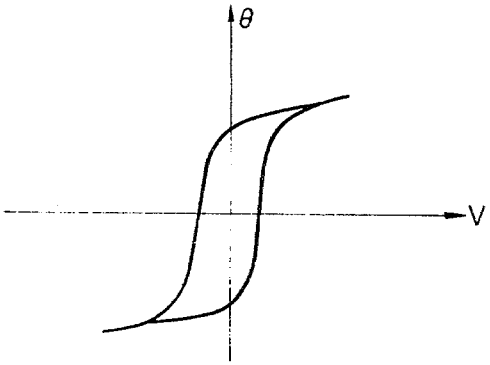
FIG. 3 is a graphical representation indicating the voltage V vs. charge Q characteristic of a nonlinear capacitor.

In FIG. 4, reference numerals 1, 2, 3, 4 and 7 designate components which are the same as or equivalent to those described having the same reference numerals in FIG. 1. Reference numeral 8 designates a Zener diode. When a supply voltage e is applied in the initial start period, a voltage ($e_0$-$V_Z$) is applied to the capacitor 7 at the phase $\theta_0$ of the supply voltage where $V_Z$ is the Zener voltage of the Zener diode 8. If the voltage is selected to be higher than the voltage at which the capacitor 7 goes into the nonlinear region, then a voltage higher than the supply voltage peak is developed across the lamp at the phase $\theta_0$ so that the diode thyristor 3 is turned on thereby allowing the preheating current to start flowing in the filaments. After the lamp has been started, a voltage ($V_L$-$V_Z$), where $V_L$ is the lamp voltage, is applied to the capacitor 7 in the positive direction. Because this voltage is low, the charging current to the capacitor 3 is reduced making the voltage across the capacitor 3 lower than the threshold voltage $V_{BO}$ of the diode thyristor as a result of which a stable discharge operation is maintained in the lamp.

That is, even if the threshold voltage $V_{BO}$ of the diode thyristor 3 is higher than the supply voltage, the diode thyristor 3 can be satisfactorily turned on by the action of the Zener diode 8 and yet the firing phase $\theta_0$ can be made to occur much earlier than the phase angle of the supply voltage peak value.

Thus, the discharge lamp lighting device according to the invention can employ a diode thyristor having a wide range of threshold voltage $V_{BO}$ without adversely affecting the preheating characteristic of the device and is therefore industrially advantageous and low in manufacturing cost.

While the invention has been described with reference to a preferred embodiment in which the diode thyristor is employed, the same effects can be obtained using a reverse blocking diode thyristor such as a PNPN switch element.

What is claimed is:

1. A discharge lamp lighting device comprising: a discharge lamp; an inductive stabilizer connected in series with said discharge lamp; a nonlinear capacitor; semiconductor switch means connected in parallel with said discharge lamp; a Zener diode connected in series with said nonlinear capacitor with the series connected nonlinear capacitor and Zener diode coupled in parallel with said discharge lamp.

2. The device as claimed in claim 1 in which said capacitor is such that, upon application of a voltage higher than a predetermined value, said capacitor stops storing charge.

3. The device as claimed in claim 1 in which said semiconductor switch means comprises a bi-directional diode thyristor.

4. The device as claimed in claim 1 in which said semiconductor switch means comprises a reverse blocking diode thyristor.

* * * * *